United States Patent [19]

Barnes et al.

[11] Patent Number: 5,044,679

[45] Date of Patent: Sep. 3, 1991

[54] LATCH CONSTRUCTION

[75] Inventors: Michael Barnes, Newtown; Joseph Koskelowsky, Danbury, both of Conn.

[73] Assignee: Norco, Inc., Ridgefield, Conn.

[21] Appl. No.: 484,799

[22] Filed: Feb. 26, 1990

[51] Int. Cl.[5] ..... E05C 3/10

[52] U.S. Cl. ..... 292/207; 292/241

[58] Field of Search ..... 70/266, 360; 292/207, 292/106, 208, 240, 241, 242

[56] References Cited

U.S. PATENT DOCUMENTS

| | | | |
|---|---|---|---|
| 1,938,339 | 12/1933 | Keil | 70/14 |
| 2,580,894 | 1/1952 | Hoffmann | 70/216 |
| 3,907,348 | 9/1975 | Bates et al. | 292/241 X |
| 4,389,062 | 6/1983 | Rosenberg | 292/241 X |
| 4,669,287 | 6/1987 | Reader et al. | 70/360 |
| 4,759,204 | 7/1988 | Neyret | 70/360 |

*Primary Examiner*—Richard E. Moore

*Attorney, Agent, or Firm*—H. Gibner Lehmann; K. Gibner Lehmann

[57] ABSTRACT

A releasable latch construction having a body member attachable to a panel, a latching member turnable on the body member for arcuate movement between a latching position and a releasing position, a locking mechanism movably carried by the body member and operable to lock the latching member in either its latching position or else in its releasing position, and an actuator movably carried in the body member and engageable with the locking mechanism, for effecting the locking or releasing movement of the latching member. The actuator is directly engageable by a latch key and is shiftable thereby in order to effect such movements.

13 Claims, 2 Drawing Sheets

LATCH CONSTRUCTION

BACKGROUND OF THE INVENTION

1. Field of the Invention

This invention relates generally to latch constructions, and more particularly to devices of a type adapted to be permanently carried on a door or panel and which can be manually operated to selectively secure or release the panel from an underlying support structure.

2. Description of the Related Art Including Information Disclosed Under 37 CFR §§1.97–1.99

U.S. Pat. No. 4,759,204 illustrates a locking mechanism having a body, a rotor, an operating arm and a piston. The piston is normally spring biased into engagement with the operating arm, and keys the operating arm to the body, against rotation. When a suitable key is inserted into the rotor and depressed, it retracts the piston in the body so as to release the keying between the operating arm and body and simultaneously keys the rotor to the operating arm, so as to enable the rotor and key to turn the arm toward an unlocking position. A relatively large number of moving parts is employed, involving multiple spring-biased tumblers and complicated structural parts that require special machining operations which result in considerable manufacturing expense. Assembly is similarly complex to the extent that it is both time-consuming and costly from the manufacturing standpoint.

A panel locking device is shown in U.S. Pat. No. 1,938,339. The disclosed lock is intended for use with sliding panels, as in showcases of the type employed to store and display various types of merchandise. The lock includes a spring biased cylinder and spring biased tumbler pin, which latter can be retracted by manual insertion of a suitable key into the cylinder. No turning of the key is required to unlock the device.

Both of the locks noted above are of a security type whose function is to prevent entry or access by unauthorized personnel. As a consequence, there is had involvement with special keys and lock cylinders of the kind having tumbler mechanisms, which are both complex and costly. With certain applications, security is not a prime consideration; instead, simplicity and reliability, as well as freedom from malfunction are the main considerations, as for example where it is desired to have a latch which is highly reliable and not prone to accidental or inadvertent release under the conditions to which it is subjected.

In the past, where efforts have been made to simplify latch structures, the results have often led to units which inherent have loosely-fitting parts that are subject to noise or rattling, excessive wear, etc. under conditions of vibration. Such characteristics have been found to be objectionable for many applications where vibration is routinely encountered, such as in internal combustion engines, aircraft/rocket engines, industrial machinery, and the like.

SUMMARY OF THE INVENTION

The above disadvantages of prior locking arrangements are obviated by the present invention, and accordingly the invention has for one object the provision of a novel and improved releasable latch construction which is both simple in its structure and operation, and reliable in use over extended periods of time.

A related object of the invention is to provide an improved releasable latch construction as above set forth, which is highly resistant to vibration and inadvertent looseness, which might otherwise result in undesirable rattling or other vibration-induced noise, or premature failure of the latch, due loosening of one or more of the components thereof.

Still another object of the invention is to provide an improved be manufactured at a relatively low cost, and which employs for the most part, drawn metal parts of simple configuration.

Yet another object of the invention is to provide an improved releasable latch construction as above characterized, which can be readily locked and unlocked by a simple movement involving insertion and turning of a suitable latch key, without the need for complex key configurations which might be difficult to manufacture or to mass produce.

A still further object of the invention is to provide an improved panel latch construction of the kind indicated, wherein assembly is facilitated, requiring a minimum of tools, and which can be readily carried out by relatively unskilled assembly personnel.

The above objects are accomplished by a novel and improved releasable latch construction for holding in place a door or panel, comprising a body member having means for attaching it to a panel, a latching member and means turnably mounting the same on the body member for arcuate movement between a latching position and a releasing position, locking means movably carried by the body member, operable to lock the latching member in either its latching position or else in its releasing position, actuator means movably carried in the body member and engageable with the locking means to actuate the latter for effecting the locking or release of the latching member, and keying means connected with the latching member, the keying means being directly engageable by a latch key to enable the latter to apply turning forces to the latching member, and the actuator means being directly engageable by the latch key and being shiftable thereby to effect unlocking of the latching member.

The arrangement is such that locking and unlocking of the latch construction is accomplished by a relatively simple movement involving insertion of a latch key into the actuator of the latch construction, depressing the key and actuator, and turning them in either of opposite directions in order to lock/unlock the latch construction. The device is constituted of relatively 1 few parts characterized by simple configurations, and is capable of being assembled with a minimum of time and equipment. Reduced manufacturing and assembly cost are thus realizeable, without sacrifice in reliability. Immunity to vibration is exceptional high, resulting in long operating life and essentially completely noise-free operation.

Other features and advantages will hereinafter appear.

BRIEF DESCRIPTION OF THE DRAWINGS

In FIG. 2, the slide member is shown as occupying a blocking position with respect to the cross pin and latching member, and in FIGS. 1 and 2 the latching member is being disposed in an unlocking position.

DESCRIPTION OF THE PREFERRED EMBODIMENT

Figure 12:
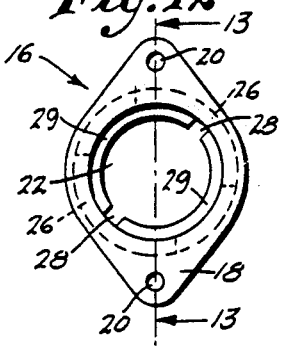
FIG. 12 is a top plan view of the body member of the releasable latch of FIGS. 1-6.
Figure 13:
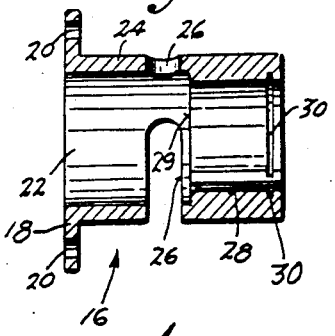
FIG. 13 is a section taken on the line 13—13 of FIG. 12.
Figure 14:
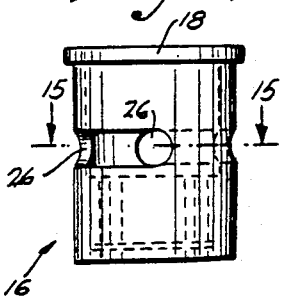
FIG. 14 is a front elevation of the body member of FIGS. 12 and 13.
Figure 15:
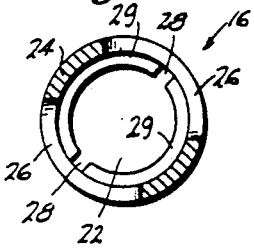
FIG. 15 is a section taken on the line 15—15 of FIG. 14.
Figure 16:
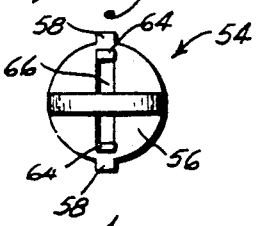
FIG. 16 is a top plan view of the blocking and unblocking slide member of the releasable latch of FIGS. 1-6.
Figure 17:
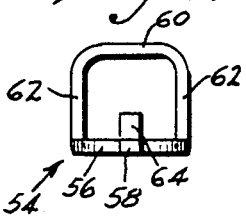
FIG. 17 is a front elevational view of the slide member of FIG. 16.
Figure 18:
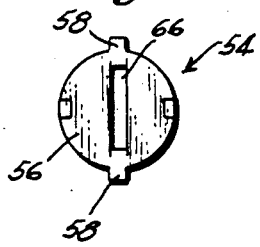
FIG. 18 is a bottom plan view of the slide member of FIGS. 16 and 17.
Figure 19:
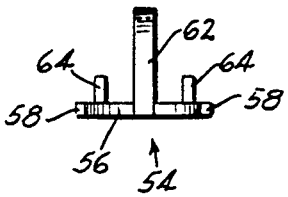
FIG. 19 is a right side elevation of the slide member of FIGS. 16-18.

Referring first to FIGS. 1-6 and in accordance with the present invention there is illustrated a novel and improved releasable latch mechanism generally designated by the numeral 10 for securing a door or panel 12 to an underlying support or jamb member 14, the mechanism 10 comprising a tubular body member 16 having at one end a mounting flange 18 with oppositely disposed mounting holes 20, and having a bore 22. The body member is particularly illustrated in FIGS. 12-15 and has an annular wall 24 with two oppositely disposed arcuate slots 26, each shown as having an angular extent of slightly over 90°. As in FIG. 12, there are two oppositely disposed longitudinal grooves 28 on the inner surface of the body member 16, and two substantially semicircular transverse grooves 30, FIG. 13, in the body member 16 adjacent its lower end. Arcuate shoulders 29, FIGS. 12 and 13, are provided in the bore 22.

Figure 20:
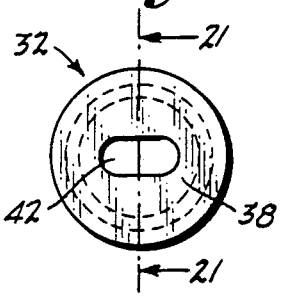
FIG. 20 is a top plan view of the keying member or sleeve of the releasable latch of FIGS. 1-6.
Figure 21:
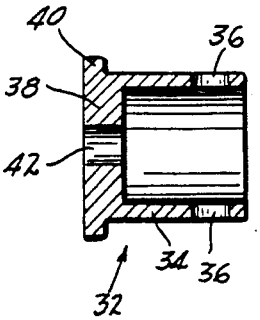
FIG. 21 is a section taken on the line 21—21 of FIG. 20.
Figure 22:
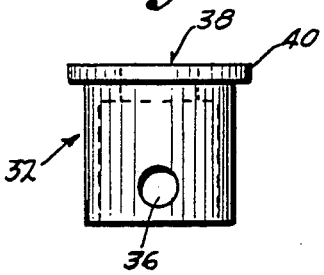
FIG. 22 is a front elevational view of the keying member or sleeve of FIGS. 20 and 21.

Telescopically received in the body member is a keying member or keying sleeve 32, FIGS. 20-22, having an annular wall 34 with two circular openings 36 therein, and having an end wall 38 with a flange 40 and having an oblong or oval opening 42. The sleeve 32 bears against the shoulders 29 and/or flange 18, and is turnable with respect thereto as will be described below.

Figure 9:
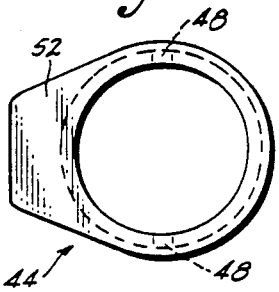
FIG. 9 is a top plan view of the latching member of the releasable latch of FIGS. 1-6.
Figure 10:
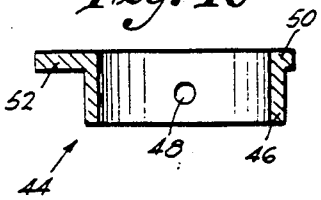
FIG. 10 is a vertical section of the latching member of FIG. 9.

Telescopically carried on the exterior of the body member 16 is a latching member 44, particularly illustrated in FIGS. 9 and 10. The latching member 44 has an annular wall 46 with oppositely disposed holes 48, an end flange 50, and a transverse latching ear or projection 52 of trapezoidal configuration, and with rounded corners.

Disposed in the body member 16 and axially movable therein is a blocking and unblocking slide member 54, particularly illustrated in FIGS. 16-19. The slide member, 54 has a keying disc 56 at its base, with oppositely disposed radially-extending protruding keying lugs 58 that are received in the oppositely disposed longitudinal grooves 28 on the inner surface of the body member 16 and thus key the slide member 54 to the body member 16 against relative rotation. The slide member 54 further includes a yoke-shaped member comprising a yoke portion 60 and oppositely disposed legs 62. The slide member 54 further has two opposite upstanding lugs 64 on its base, and the lugs 64 are preferably punched out from the disc and bent upwardly, leaving a central slot 66 in the base. In addition, the upstanding lugs 64 and the legs 62 of the yoke-shaped member are in quadrature relation with one another, as shown.

Figure 7:
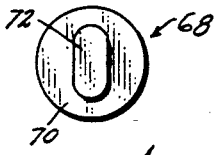
FIG. 7 is a top plan view of the actuator member of the releasable latch of FIGS. 1-6.
Figure 8:
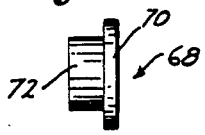
FIG. 8 is a right side elevation of the actuator member of FIG. 7.
Figure 6:
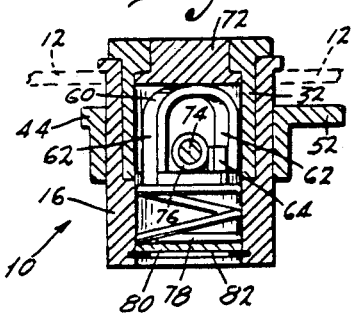
FIG. 6 is a vertical section similar to FIG. 5, except that the latch key has been removed from the keying member.

Disposed within the keying member 68, particularly illustrated in FIGS. 7 and 8. The actuator member has a disc-like base 70 and an upstanding projection 72 of oblong or oval, or other non-circular cross-sectional configuration, and having a size adapted to fit in the opening 42 in the r end wall 38 of the keying member 32, as in FIGS. 2, 3, 5 and 6.

Figure 11:
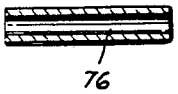
FIG. 11 is an axial section of a sleeve employed with the cross pin of the releasable latch of FIGS. 1-6.

As illustrated in FIGS. 2, 3, 5 and 6, there is provided on the keying member 32 a cross pin 74, preferably including a tubular spacer sleeve 76 illustrated in FIG. 11. The cross pin 74 is headed over at its opposite ends, and extends through the slots 26 in the body member 16, through the holes 36 in the keying member 32, and through the holes 48 in the latching member 44. The cross pin 74 also extends through the arch formed by the yoke-shaped member, namely the yoke 60 and legs 62 of the slide member 54.

Carried in the bore 22 of the body member 16 is a compression spring 78 and an abutment disc 80, the latter being retained by an expansion ring 82 received in the semi-circular transverse groove 30 in the inner surface of the body member 16. As illustrated, one end of the spring 78 bears against the abutment disc 80, whereas the other end of the spring 78 bears against the underside of the keying disc 56 of the slide member 54. The spring 78 thus operates to bias the slide member 54 in an upward direction such that the upper surface of the disc 56 thereof engages the sleeve 76 of the cross pin 74 in the absence of a downward, external axial force applied to the actuator member 68.

Figure 2:
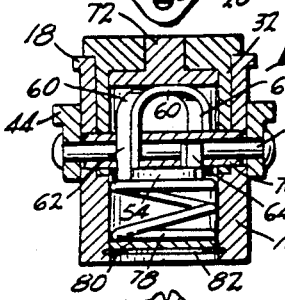
FIG. 2 is a vertical section of the releasable latch of FIG. 1, and illustrating the body member, the latching member, a cross pin carried by the latching member, the keying member, the actuator member, and a slide member moveable in the body member and engageable by the actuator member, for selectively blocking and unblocking the cross pin on the latching member. In its unblocking or retracted position, the slide member enables the latching member to be turned by the keying member, between its locking and unlocking positions.
Figure 3:
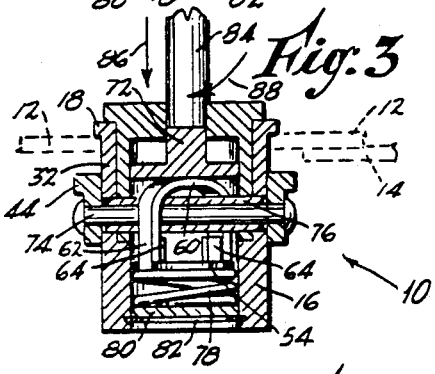
FIG. 3 is a view similar to FIG. 2, illustrating a latch key having been inserted in the keying member of the releasable slide member and thereby enable the latching member to be rotated, via the keying member, by the latch key.
Figure 4:
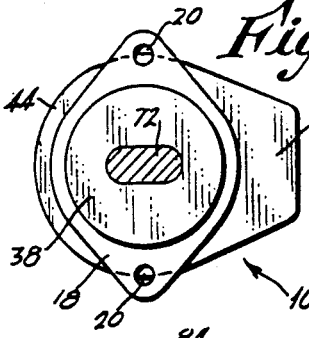
FIG. 4 is a view similar to FIG. 1, illustrating the latching member as having been rotated by the latch key, illustrated in section, to a locking position which is displaced by 90° from its unlocking position shown in FIG. 1.

In FIGS. 2 and 3, the cross pin 74 thus normally occupies a position wherein it extends through the arch of the yoke-shaped member at an angle with respect to the plane of the yoke 60 and legs 62. One portion of the cross pin 74 thus lies between one leg 62 and one lug 64, whereas another portion lies between the other leg 62 and other lug 64.

Figure 1:
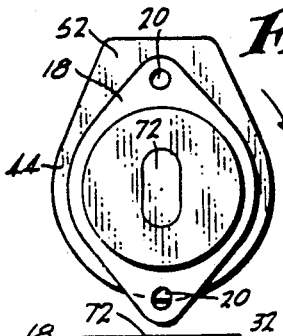
FIG. 1 is a top plan view of the improved releasable latch of the present invention, comprising a body member having a mounting flange, a keying member carried therein, an actuator member having a projection extending through a hole in the keying member, and a latching member turnable on the body member between locked and positions.

In operation, assuming that the components of the releasable latch 10 of the invention are disposed in the relative positions illustrated in FIGS. 1 and 2, it can be seen that the latching member 44, which is rigid with the cross pin 74, is retained against inadvertent rotation by the engagement of the cross pin 74 with the legs 62 and the upstanding lugs 64 of the slide member 54. Even if a modest turning force is applied to the keying member 32, the latching member 44 cannot turn with respect to the body member 16.

If a suitable latch key 84 having a configuration similar to that of the opening 42 in the keying member 32 is inserted therein and shifted in the direction of the arrow 86 in FIG. 3, so as to effect axial movement of the actuator member 68, the spring 78 will undergo compression, and the slide member 54 will be retracted to a point where the lugs 64 thereof clear the cross pin 74 and its sleeve 76. If the latch key 84 is then turned as 1 indicated by the arrow 88 in FIG. 3, the turning movement is transmitted, via the keying member 32 which slidably bears on the shoulders 29, to the cross pin 74 and sleeve 76, which are free to slide along the slots 26 of the body member 16, from the position of FIGS. 1–3 to the position of FIG. 5, with the slide member 54 still retracted. The latching member 44 will then be disposed in the position of FIGS. 4–6, with the ear 52 thereof having the position of FIG. 6, and underlying the jamb member 14 of FIG. 3. If the latch key 84 is now withdrawn, the actuator member 68 will move upwardly in FIGS. 5 and 6, enabling the slide member 54 to return to its advanced position, FIG. 6, under the action of the spring 78, wherein the lugs 64 and legs 62 again surround the cross pin. In particular, the cross pin 74 will be confined by the legs 62 and the upstanding lugs 64, and as long as the slide member 54 occupies its advanced position illustrated in FIG. 6, the cross pin 74 and latching member 44 will be reatined against inadvertent turning with respect to the body member 16, even in the presence of a turning force applied to the keying member of sleeve 32. The latching member 44 thus occupies the locked position, wherein its ear 52 underlies the jamb surface 14 of FIG. 3.

Figure 5:
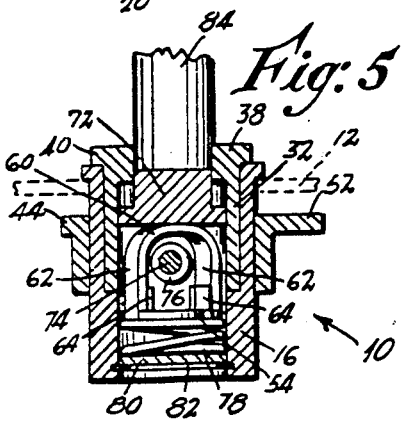
FIG. 5 is a vertical section similar to FIG. 3, of the releasable latch construction, with its actuator member depressed by the latch key, and with the actuator member and the latching member in the positions illustrated in FIG. 4.

Restoration of the latching member 44 to its unlocking position is accomplished by a similar procedure, involving insertion of the latch key 84 into the hole 42 of the keying member or sleeve 32 so as to depress the actuator member 68 against the action of spring 78, FIG. 5, which in turn retracts the slide member 54 and enables the keying member 32 and cross pin 74 (which is now clear of the lugs 64), to carry the latching member 44 to the position of FIG. 1. Release of the latch key 84 permits the spring 78 to advance the slide member 54 once again, thereby locking the latching member 44 against rotation with respect to the body member 16.

The arrangement is such that the spring 78 normally biases the slide member 54, which is keyed against rotation with respect to the body member 16 by the lugs 58 and grooves 28, to a position wherein the legs 62 of its yoke-shaped member and upstanding lugs 64 block lateral turning movement of the cross pin 74. When the latch key 84, through the actuator member 68, retracts the slide member 54 against the action of the spring 78, the lugs 64 of the slide member 54 clear the cross pin 74 and permit it and the latching member 44 which carries it, to be turned between its locking (FIG. 6) and unlocking (FIG. 2) positions. Movement between such positions can take place only when the actuator member 68 is depressed, and when a turning force in the proper direction is applied to the keying member 32 by means of the latch key 84.

From the above it can be seen that there has been provided a novel and improved releasable latch construction which is simple in its structure and economical to manufacture and fabricate, since the various parts have a relatively simple physical configuration, and can be formed for the most part, as drawn metal parts. No tumblers or tumbler pins are involved whatsoever, and thus there are eliminated the problems attendant therewith.

Significantly improved immunity against vibration is provided, resulting in virtually noise free performance. Since no threaded parts are involved in the construction, there is no possibility of loosening of the various components under conditions of vibration, and accordingly the latch has been found to be especially adaptable for use in aircraft, where vibration is routinely encountered. In addition, the need for thread-locking resins and the like, typically required for equipment involving threaded parts, is completely eliminated by the present construction.

The disclosed device is thus seen to represent a distinct advance and improvement in the field of releasable latch constructions.

Variations and modifications are possible without departing from the spirit of the invention.

What is claimed is:

1. A releasable latch construction for holding in place panels and the like, comprising in combination:

a) a body member having means for attaching it to a panel, b) a latching member and means turnably mounting the same on the body member for arcuate movement between a latching position and a releasing position, c) locking means movably carried by the body member, operable to lock the latching member in either its latching position or else in its releasing position, d) actuator means movably carried in the body member and engageable with said locking means to actuate the latter for effecting the locking or release of said latching member, and e) keying means connected with said latching member, said keying means being directly engageable by a latch key to enable the latter to apply turning forces to the latching member and said actuator means being directly engageable by said latch key and being shiftable thereby to effect unlocking of the latching member, f) said latching member comprising a ring which encircles the body member, g) said body member having a slot, and h) said latching member having a cross pin passing through the slot of the body member.

2. A latch construction as set forth in claim 1, wherein:

a) the locking means comprises a slide member having an opening through which the said cross pin passes.

3. A latch construction as set forth in claim 2, wherein:

a) said slide member is movable in the body member, b) said members having cooperable keying means to prevent relative turning of the members.

4. A latch construction as set forth in claim 2, wherein:

a) the slide member comprises a keying disc and a yoke piece having legs which are attached at their extremities to peripheral portions of said disc.

5. A latch construction as set forth in claim 4, wherein:

a) the body member has a second slot through which the cross pin also passes, b) said keying disc having a pair of upstanding lugs which are parallel to and spaced from the legs of the yoke piece, c) said legs and lugs being selectively engageable with the cross pin, and being disposed in quadrature relation.

6. A latch construction as set forth in claim 2, wherein:

a) the locking means includes a spring acting against the slide member and against the body member.

7. A latch construction as set forth in claim 4, wherein:

a) the locking means includes a spring acting against the keying disc and against the body member.

8. A latch construction as set forth in claim 6, wherein:

a) the body member has a bore in which the slide member moves, b) an abutment disc disposed in the bore of the body member, c) an expansion ring carried in said bore and immovable in the body member, d) said spring being in engagement with said abutment disc.

9. A latch construction as set forth in claim 1, wherein:

a) said cross pin has a jacket in the form of a sleeve which engages the body member.

10. A latch construction as set forth in claim 1, wherein:

a) said body member is cylindrical and has a second slot, b) both said slots extending circumferentially of the body and being coplanar, c) said cross pin passing through both said slots.

11. A latch construction as set forth in claim 2, wherein:

a) said keying means comprises a sleeve which is turnable within the body member, b) said keying sleeve having openings in its walls, through which the cross pin passes.

12. A latch construction as set forth in claim 11, wherein:

a) said keying means has an end wall with a non-circular aperture, b) said actuator means comprising a member having a non-circular projection which slidably fits in said non-circular aperture.

13. A releasable latch construction for holding in place panels and the like, comprising in combination:

a) a body member having means for attaching it to a panel, b) a latching member and means turnably mounting the same on the body member for arcuate movement between a latching position and a releasing position, c) locking means movably carried by the body member, operable to lock the latching member in either its latching position or else in its releasing position, d) actuator means movably carried in the body member and engageable with said locking means to actuate the latter for effecting the locking or release of said latching member, and e) keying means connected with said latching member, said keying means being directly engageable by a latch key to enable the latter to apply turning forces to the latching member and said actuator means being directly engageable by said latch key and being shiftable thereby to effect unlocking of the latching member, f) said body member, latching member and keying means comprising three telescoping sleeves having openings in their walls, and g) a cross pin passing through the said wall openings, securing said sleeves in assembled telescoped relation.

* * * * *